United States Patent [19]

Buyak et al.

[11] Patent Number: 4,952,906

[45] Date of Patent: Aug. 28, 1990

[54] STROBE ALARM CIRCUIT

[75] Inventors: William P. Buyak, New Hartford; Bruce V. Testa, Cromwell, both of Conn.

[73] Assignee: General Signal Corporation, Stamford, Conn.

[21] Appl. No.: 303,887

[22] Filed: Jan. 27, 1989

[51] Int. Cl.[5] ..... G08B 5/00

[52] U.S. Cl. ..... 340/331; 315/241 S

[58] Field of Search ..... 340/471, 326, 331, 310 R, 340/815.01, 384 E, 384 R; 331/139; 315/125, 200 A, 241 S

[56] References Cited

U.S. PATENT DOCUMENTS

| | | | |
|---|---|---|---|
| 4,101,880 | 7/1978 | Haus | 340/331 |
| 4,132,926 | 1/1979 | Ohta et al. | 315/135 |
| 4,155,069 | 5/1979 | Mason | 340/471 |
| 4,271,375 | 6/1981 | Hosono | 315/135 |
| 4,274,084 | 6/1981 | Haus | 340/384 E |
| 4,480,211 | 10/1984 | Eggers | 340/331 |
| 4,499,453 | 2/1985 | Right | 340/326 |
| 4,594,573 | 6/1986 | Yeshino et al. | 331/139 |
| 4,684,852 | 8/1987 | Balogh | 315/200 A |

*Primary Examiner*—Joseph A. orsino

*Assistant Examiner*—Brent A. Swarthout

*Attorney, Agent, or Firm*—Robert R. Hubbard; William G. Miller, Jr.

[57] ABSTRACT

A strobe light circuit is provided for flashing a strobe flash unit at a desired frequency. An inductor is repetitively connected and disconnected across a d.c. power line by a switch means so that energy is stored in the inductor during the period when the circuit is complete. The flash unit and a capacitor are connected in parallel so that the capacitor can discharge its stored energy to the flash unit when the voltage across the capacitor exceeds the threshold firing voltage of the flash unit. The parallel combination of the flash unit and the capacitor is in turn connected in series with a diode, and the resulting series circuit is connected across the inductor with the diode being connected in polarity such that current will not flow from the power line through the flash unit or the capacitor. The switch means is repetitively cycled so that over the period of each flash cycle the energy supplied to the inductor from said power line while the switch is closes and thence to the capacitor while the switch is open will substantially equal that amount of energy required to charge the capacitor to the threshold firing voltage of the flash unit.

12 Claims, 3 Drawing Sheets

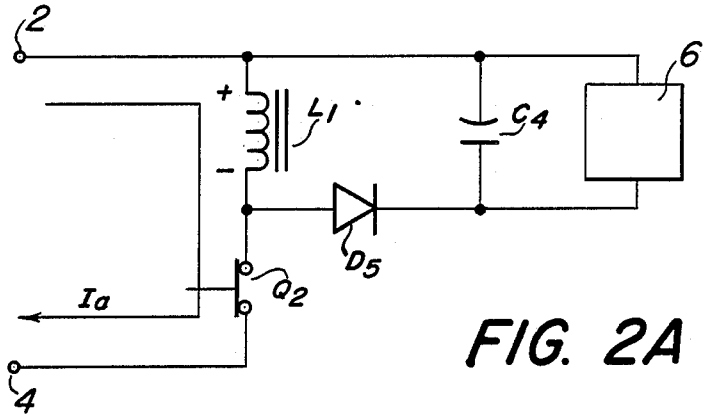
FIG. 2A
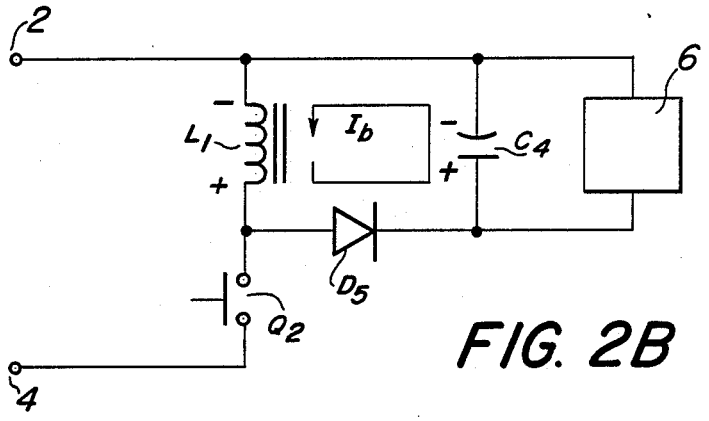
FIG. 2B
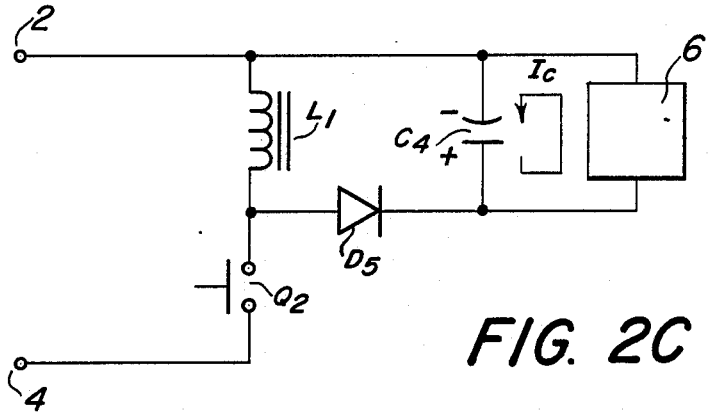
FIG. 2C
FIG. 2

STROBE ALARM CIRCUIT

BACKGROUND OF THE INVENTION

This invention relates to circuits for electronic strobe lights such as are used to provide visual warning in electronic fire alarm devices and other emergency warning devices. These devices are frequently associated with audible warning devices such as horns, and provide an additional means for getting the attention of those persons who are in danger. For operation the strobe lights require a trigger circuit for initiating the firing of the flashtube. The trigger circuit can be considered part of the flash unit since its only use is to trigger the flash. Typically energy for the flash is supplied from a capacitor in shunt with the flash unit and occurs when the voltage across the flash unit exceeds the threshold value, typically 250 v., required to actuate the trigger circuit. After the flashtube is triggered, it becomes conductive and rapidly drains the stored energy from the shunt capacitor until the voltage across the flashtube has decreased to approximately 30 v. At that point, the flashtube extinguishes and becomes non-conductive.

Typical of the prior art devices is the circuit whose operation is shown in FIG. 1. This circuit, as shown in FIG. 1A, includes power supply terminals 2 and 4, across which is connected the supply voltage, and which may typically be 10/12 volts dc or 20/24 volts dc. Underwriters Laboratory specifications require that operation of the device must continue when the supply voltage drops to as much as 80% of the nominal value and also when it rises to 110% of the nominal value. Thus in the lower voltage range the unit must operate between 8 and 13.2 v., and in the upper voltage range operation must be sustained in the range of 16 v. and 26.4 v. It is also a requirement of UL specifications that the flash rates of such visual signalling devices must fall between 20 and 120 flashes per minute (FPM).

In FIG. 1A, the prior art device, an inductor $L_1$ is connected by switch $Q_2$ across the power supply to cause current $I_a$ to flow through the inductor and thereby store energy in it. Across the switch $Q_2$ there is connected a series circuit comprised of a diode $D_5$ and the parallel combination of a capacitor $C_4$ and a flash unit 6. With the switch $Q_2$ closed, as shown in FIG. 1A, no current will flow in the flash unit or capacitor $C_4$.

When the switch $Q_2$ is opened, as shown in FIG. 1B, the inductor, which was charged by the current flow $I_a$ will begin to discharge as its flux field collapses, and a current $I_b$ will flow through and charge the capacitor $C_4$. In order to build up the voltage across the capacitor to the 250 v. needed to cause the flashtube to fire, when the power supply being used is a low voltage d.c., the switch is cycled at regular intervals. When the capacitor voltage has built up to 250 v., the flash unit will be fired to discharge the capacitor rapidly by the current flow $I_c$, as shown in FIG. 1C, until the voltage across the capacitor drops to about 30 v. and the flashtube extinguishes. Strobe circuits, such as shown in FIG. 1, have been found to have a number of disadvantages. These include the disadvantage of having the capacitor charging current $I_b$ flowing in the lines from the supply. Such current flows may cause electromagnetic or radio frequency interference. This is particularly so in alarm installations which have long lead lines. Also, as is shown in FIG. 1C, the flash tube is effectively across the power line and the current $I_c$ is limited only by the effective d.c. resistance of the circuit and source, which is typically below in efficient designs. The result can then be a large destructive current.

Other problems which exist in the prior art devices include the tendency for the flash rate to vary sufficiently with variations in supply voltage to cause the flash rate to fall below or exceed the UL requirements. Also, it is desirable to have one unit which will operate with all of the normally encountered supply voltages.

In order to overcome these problems, it is an object of this invention to provide a strobe light circuit whose flash rate is not dependent on the supply voltage.

It is also an object of this invention to provide a unit which will operate over a range of 8 to 26.4 volts dc.

It is a further object of this invention to provide a strobe circuit whose configuration is such that there will be no excessive current in any stage of its operation.

SUMMARY OF THE INVENTION

A strobe light circuit is provided for flashing a flash unit at a desired frequency. An inductor is repetitively connected and disconnected across a d.c. power line by a switch means so that energy is stored in the inductor during the period when the circuit is complete and discharged when the circuit is broken. The flash unit and a capacitor are connected in parallel so that the capacitor can discharge its stored energy to the flash unit when the voltage across the capacitor exceeds the threshold firing voltage of the flash unit. The parallel combination of the flash unit and the capacitor is in turn connected across the inductor at least during the open period of the switch in a manner so that current will not flow from the power line through the flash unit or the capacitor. If the frequency of flashing needs to be independent of the supply voltage, the closed period of the switch is initiated in response to timing signals and the open period is initiated when the current through the inductor attains the value required to provide the desired flashing frequency.

BRIEF DESCRIPTION OF THE DRAWINGS

In the drawings, in which like reference characters identify like elements:

FIG. 2 includes FIGS. 2A, 2B and 2C which are circuit diagrams showing the operation of the invention.

DESCRIPTION OF THE PREFERRED EMBODIMENT

Figure 1:
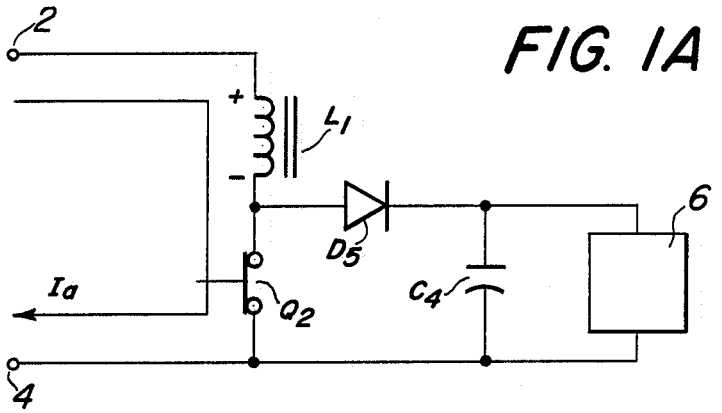
FIG. 1 (PRIOR ART)
FIG. 1 includes FIGS. 1A, 1B and 1C which are circuit diagrams showing the operation of a prior art device.
Figure 1:
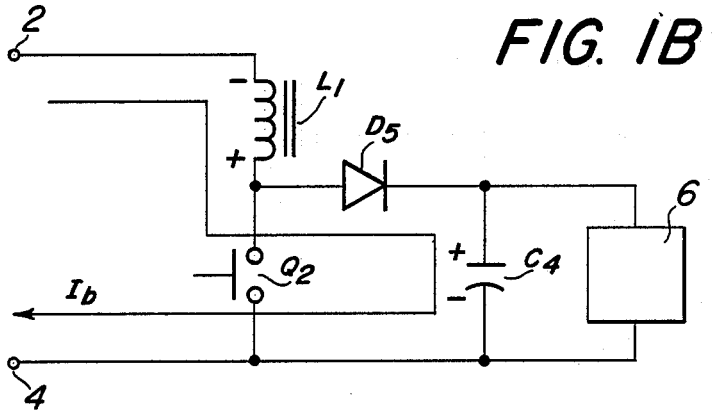
FIG. 1 (PRIOR ART)
Figure 1:
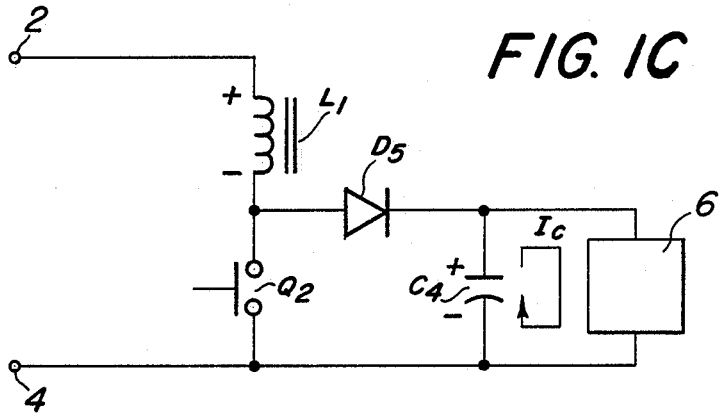
FIG. 1 (PRIOR ART)

FIG. 2 shows in its FIGS. 2A, 2B and 2C the novel circuit of the present invention and the manner in which it operates. In this connection the inductor $L_1$ is connected repetitively across the power supply terminals 2 and 4 by a switch means $Q_2$, as in FIG. 1. The parallel combination of the flash unit 6 and the capacitor $C_4$ along with the diode $D_5$, however, is not connected across the switch means, as in FIG. 1. Instead, it is connected across the inductor.

When the switch means $Q_2$ is closed, as shown in FIG. 2A, the current $I_a$ flows to store energy in the inductor. When the switch means $Q_2$ is opened, as shown in FIG. 2B, the collapsing field of the inductor induces a voltage in the inductor having the polarity shown, and its energy will flow to the capacitor causing the current flow $I_b$ through diode $D_5$. The voltage which appears across the inductor as a result of the opening of the switch means will, of course, be a very high voltage for its magnitude is proportional to the rate of change of the flux linking the inductor, and that rate is extremely high in any switch opening. During the open period of each switch cycle the inductor will discharge its energy to the capacitor until the voltage across the inductor and that across the capacitor are equal. The repetitive opening and closing of the switch will eventually charge the capacitor to the point where the voltage across it attains the threshold value required to fire the flashtube. When that point is reached the capacitor discharges through the flashtube, as illustrated by the current flow $I_c$ in FIG. 2C.

It will be noted that with the arrangement of FIG. 2, the flash unit is never across the power line as in the prior art and the charging current for the capacitor does not flow through the power line.

In the circuit of FIG. 2, the timing of the period between flashes is determined by how long it takes to charge capacitor $C_4$ to the threshold firing voltage of the flash unit 6. It is desirable to make this period, and therefore the flash frequency, dependent on factors other than the supply voltage. With the circuit of FIG. 2 that is possible by controlling the rate at which the energy for charging the capacitor is fed to the capacitor. Since all of the energy which goes to charging the capacitor comes from the energy stored in the inductor, it is possible to control the flash rate by controlling the rate at which energy is supplied from the power supply to the inductor.

If it is desired to have the flashtube operate at a rate of 60 FPM (flashes per minute), it is necessary to supply the energy for the flashtube to the capacitor at a rate such that over a period of 1 second the capacitor will attain the threshold voltage of the flash tube and initiate firing of the tube. It is known that the energy, in Joules, stored in a capacitor of capacitance C that attains a voltage V is determined by using the following formula:

$$\text{Joules}=0.5CV^2$$

Also, the rate at which the energy is supplied, the power into the capacitor, can be found by the following relationships:

$$\text{Watts}=\text{Joules/time.}$$

And since $$\text{Time}=1/\text{Hz}$$

then $$\text{Watts}=\text{Joules}\times\text{Hz}$$

The watts required for a given flash rate is then $$P_c=0.5\times C_4\times V^2\times \text{Hz}_c$$

where $\text{Hz}_c$ is the frequency at which the capacitor is charged and discharged and hence the frequency of flashing, such as once per second.

A relationship can also be established for the energy stored in the inductor $L_1$ when the current flow through the inductor attains a value I, as follows:

$$\text{Joules}=0.5LI^2$$

and, since $$\text{Watts}=\text{Joules}\times\text{Hz}_1$$

where $\text{Hz}_1$ is the frequency of the cycling of the switch $Q_2$, then the watts delivered from the inductor $L_1$ for a given flash rate is given by:

$$P_1=0.5\times L_1\times I^2\times \text{Hz}_1$$

If we assume that all of the energy stored in the inductor $L_1$ goes to charge the capacitor $C_4$, then $$P_c=P_1 \text{ and}$$

$$C_4\times V^2\times \text{Hz}_c=L^1\times I^2\times \text{Hz}_1 \text{ or}$$

$$\text{Hz}_1=(C_4\times V^2\times \text{Hz}_c)/(L_1\times I^2)$$

Thus, using typical values, if $C_4$ is $(10\times10^{-6})$ farads, $V^2$ is (250 volts)$^2$, $\text{Hz}_c$ is 1 cycle/sec., $L_1$ is 0.00137 henries and $I^2$ is (0.3666 amps)$^2$, the value for $\text{Hz}_1$ that is necessary to cause the flashtube to cycle at the frequency of 1 Hz can be determined to be approximately 3 kHz.

It is then necessary to determine if the assumed inductor current (0.3666 amps) can be attained in the period of one cycle of the switch, namely in 1/3000th of a second. The current in the inductor can be expressed by the following equation:

$$i=E/R(1-e^{-Rt/L})$$

Using the parameters set forth above by way of example and assuming R is 1.5, which will be discussed in connection with FIG. 3, then $$i=1.632\text{amps.}$$

after 1/3000th of a second, and since that value exceeds the required current of 0.3666 amps, the inductor can store the required amount of energy in a single cycle of the switch to make the relationships set forth for the energy transfer valid.

Figure 3:
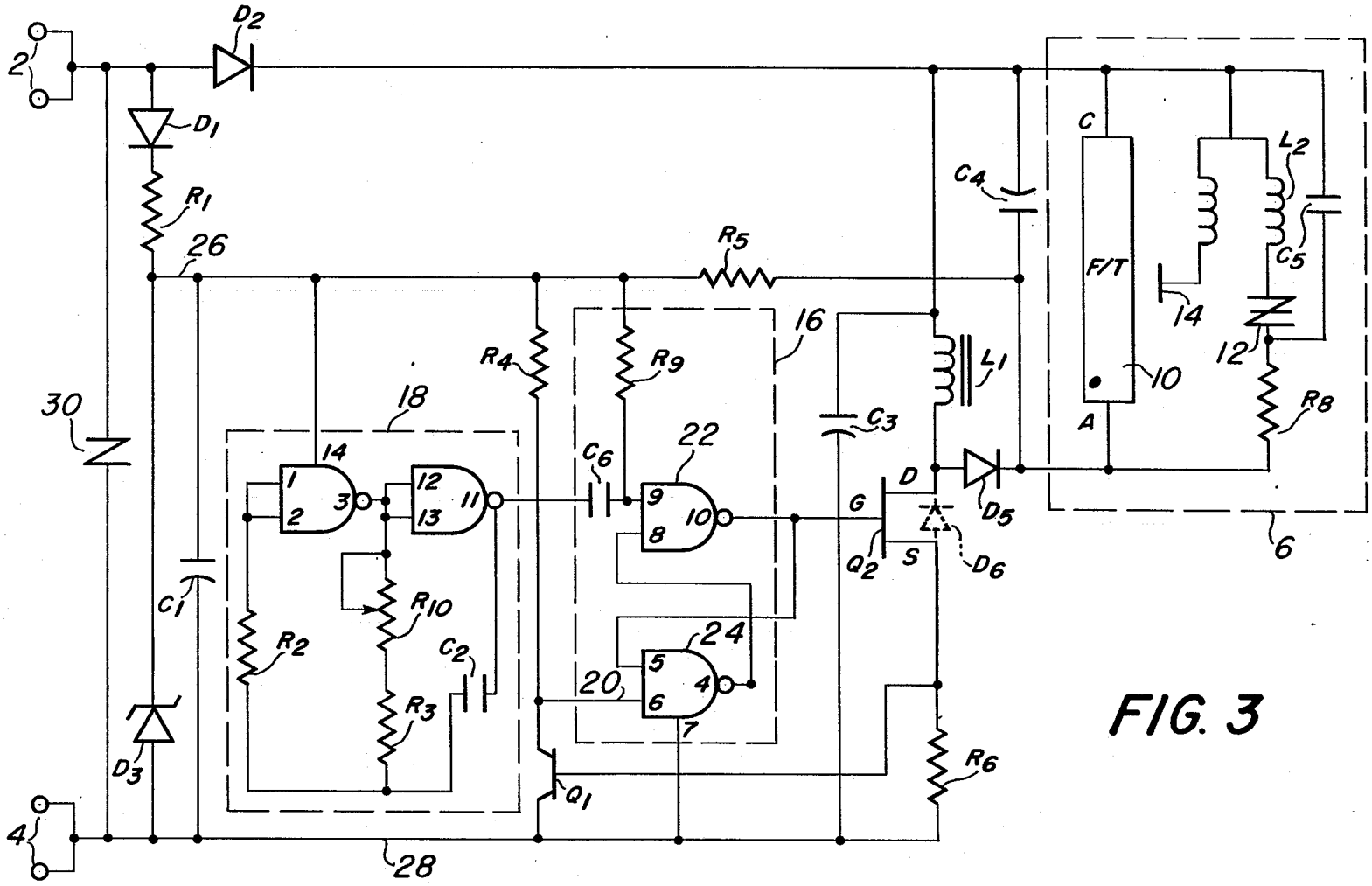
FIG. 3 is a circuit diagram showing in detail one form of the inventive circuit.

With a circuit such as is shown in FIG. 3, the strobe flashing rate is determined independently of the supply voltage and the circuit will provide suitable alarm operation for a range of supply voltages from 8 v. to 26.4 v. d.c.

In FIG. 3 the flash unit 6 is shown as having a flash tube 10 shunted by a trigger circuit which includes the resistor $R_8$ connected in series with the parallel combination of capacitor $C_5$ and the primary of autotransformer $L_2$ and SIDAC 12. The secondary of the autotransformer is connected to the trigger band 14 of the flashtube 10 so that when the voltage across the flashtube exceeds its threshold firing voltage SIDAC 12 will break down and the charge on $C_5$ will flow through the primary of the autotransformer inducing a voltage in its secondary causing the flashtube to become conductive. As previously mentioned, the flashtube will quickly discharge the energy stored in capacitor $C_4$ so that the capacitor can be recharged from the inductor $L_1$ through diode $D_5$.

The recharging of the capacitor $C_4$ by $L_1$ is timed by a circuit which includes a resistor $R_6$, which serves to provide a voltage drop which will give an indication of the magnitude of the current flowing through $L_1$ when the switch $Q_2$ is closed, and switch $Q_2$, a power MOSFET which is rendered conductive by the output of an RS F/F, 16. The F/F is set by the output of the oscillator 18 and is reset by transistor switch $Q_1$ becoming conductive to cause current to flow through resistor $R_4$ to bring the potential on line 20 to that of terminal 4.

The flip-flop 16 includes two NAND gates, 22 and 24, connected in the usual manner to form the flip-flop. Also, there is included the RC network consisting of resistor $R_9$ and capacitor $C_6$ which form a differentiator which serves to produce narrow spikes on the input to NAND gate 22 at terminal 9.

When $Q_2$ is conducting the current flow through $L_1$ and $R_6$ builds up until the voltage drop across $R_6$ equals the 0.55 volts required on the base of $Q_1$ to make it conductive. In order to have a drop of 0.55 volts when a current of 0.3666 amps is flowing the resistor $R_6$ must have a value of 1.5 ohms. When $Q_1$ is conductive a logical "0" is transferred into RS F/F 16. This causes the output of F/F 16 to switch from a logical "1" to a "0" rendering $Q_2$ non-conductive. $Q_2$ remains non-conductive until the next clock pulse from oscillator 18 is received through capacitor $C_6$ at terminal 9 of NAND gate 22.

The oscillator 18 is constructed with two NAND gates and the necessary RC networks to provide the desired frequency, 3 kHz, for example. This RC network includes resistors $R_2$, $R_3$ and potentiometer $R_{10}$, as well as capacitor $C_2$. The resistor $R_{10}$ serves to adjust the frequency of the oscillator, as may be required.

The power supply is provided from terminals 2 and 4 which will normally have a polarity in which 4 is positive and 2 is negative when no alarm condition is present. Those polarities will reverse when an alarm condition is present as is the usual procedure in supervised systems.

The diodes $D_1$ and $D_2$ prevent current flow in the circuit elements when no alarm condition exists. When terminal 2 does become positive due to an alarm condition, those diodes become conductive and the circuit operates the flash unit at the set frequency.

The Zener diode $D_3$ in combination with resistor $R_1$ regulates the voltage on the power supply lines 26 and 28, which supply the logic circuits. This power supply is filtered by $C_1$ and is protected from transients in which the voltage across the terminals 2 and 4 exceeds 50 volts by the Metal Oxide Varistor 30.

A novel aspect of this invention is provided by the use of Resistor $R_5$ as a safety discharge path for $C_4$ so that no hazard will be present in the circuit when it might accidentally be touched by someone. The manner in which $R_5$ is connected in the circuit provides an additional benefit in that it increases the logic power supply voltage during low operating voltage conditions. In this connection, $R_5$ is connected to complete a circuit between lines 26 and 28 which includes $C_4$, $R_5$, $L_1$, $D_6$ (an internal diode of $Q_2$) and $R_6$ so that as capacitor $C_4$ discharges through that circuit it tends to support the voltage required between those lines.

By way of example, the following parameters may be used for the elements of FIG. 3 to obtain a flash frequency of 60 FPM:

| element | value or No. |
|---|---|
| $D_1$, $D_2$ | 1N4004 |
| $D_5$ | 1N4934 |

-continued

| element | value or No. |
|---|---|
| $R_1$ | 2.2K |
| $R_2$ | 1 M |
| $R_3$ | 100K |
| $R_4$ | 100K |
| $R_5$ | 4.7M |
| $R_6$ | 1.5 ohms |
| $R_8$ | 100K |
| $R_9$ | 470K |
| $R_{10}$ | 500K |
| $C_1$ | 4.7 microfarads |
| $C_2$ | 470 picofarads |
| $C_3$ | 47 microfarads |
| $C_4$ | 10 microfarads |
| $C_5$ | .047 microfarads |
| $C_6$ | 22 picofarads |
| $Q_1$ | 2N3417 |
| $Q_2$ | IRF723 |
| 30 | V39Z1 |
| 12 | K2400F2 |
| IC | CD4011B (osc. and F/F) |

By way of summary, this invention solves a number of problems found in prior art devices. The problem with the capacitor currents flowing in the power lines and the large currents which occur because the flash tube is placed across the power lines is solved by placing the flashtube and its parallel capacitor across the inductor instead of across the switch.

The problem of variation in the flashing rate with changes in supply voltage is solved by storing in the inductor a particular amount of energy during each cycle of the switch instead of storing an amount of energy dependent on the magnitude of the supply voltage. This change is accomplished by initiating the open period of the switch in response to the inductor current flow reaching a certain value and initiating the closed period by a timing signal which has a regular period so that the amount of energy stored in the inductor is the same in each cycle of the switch. That contrasts with the prior art method in which both the opening and the closing of the switch was controlled to occur at regular intervals by the same timing signal.

The novel circuit of FIG. 3 also provides the benefit of being universally useful at both of the common supply voltages. Thus, only one unit needs to be stocked by suppliers. The resulting economies are, of course, obvious.

Still another feature supplied by the circuit of FIG. 3 is the fact that the discharging circuit for capacitor $C_4$, which is required for safety, is provided in such a way that the discharged energy goes to supporting the power supply to the logic circuit during periods of low voltage.

In addition to the above the circuit of FIG. 3 provides the disconnect diodes needed for four wire supervised systems, namely diodes $D_1$ and $D_2$, which prevent current flow in the circuit when there is no alarm condition but allow current flow when the polarity of the supply is reversed as under an alarm condition.

What is claimed is:

1. A strobe light circuit for flashing a flashtube at a desired frequency, comprising:

a dc power source for providing power at a predetermined voltage;

an inductor for storing energy;

switch means for connecting and disconnecting said inductor across said source to store energy in said inductor during the periods of connection;

a flash unit which includes said flashtube and is operable to fire said flashtube to generate a light output upon the application across said unit of its threshold firing voltage;

a capacitor connected in parallel to said flash unit so that said capacitor will cause the firing of said flashtube and the discharge of its stored energy through the flashtube upon the attainment of a voltage across said capacitor corresponding to said threshold firing voltage;

means for connecting said parallel combination of said flash unit and said capacitor effectively across said inductor when said inductor is disconnected from said power source by said switch means; and means for repetitively cycling said switch means between its open and closed state.

2. A circuit as set forth in claim 1 in which the means for repetitively cycling said switch means is operable to initiate the open period of the switch in response to the current through the inductor attaining a particular value and the closed period is initiated by a timing signal at regular intervals.

3. A circuit as set forth in claim 1 in which said means for connecting said parallel combination of said flash unit and said capacitor across said inductor is a diode poled so that current will not flow from said source through said parallel combination.

4. A circuit as set forth in claim 1 in which a resistor is connected in series with said inductor across said source at least when said switch means is in its closed state; and said means for repetitively cycling said switch means is operative to initiate the open period of said switch cycles in response to a particular value of current flow through the resistor and to initiate the closed period in response to a periodic timing signal.

5. A circuit as set forth in claim 1 in which a resistor is connected in series circuit with said inductor across said source when said switch means is in its closed state; and said means for repetitively cycling said switch means is operative to initiate the closed period of said switch cycle at regular intervals and to initiate the open period of said switch cycles in response to the value of current flow through the resistor attaining an initiating value which will indicate storage in said inductor of sufficient energy in one of said switch cycles such that, upon transfer of that energy to said capacitor during the open state of all of the switch cycles in the period of one flash cycle at the desired flash frequency, the capacitor will attain a charge of sufficient energy to produce across said capacitor the threshold firing voltage of said flash unit.

6. An alarm circuit of the type in which the power supply for the alarming unit has its polarity reversed to indicate an alarm condition, comprising:

a series circuit including at least an inductor for storing energy;

a parallel circuit including a capacitor in parallel with a flash unit, said flash unit including a flashtube for providing a visual alarm and a triggering circuit for firing said flashtube when the voltage across said parallel circuit attains the threshold firing voltage of said triggering circuit;

switch means for connecting and disconnecting said power supply across said series circuit;

means for connecting said series circuit across said parallel circuit at least when said power supply is disconnected from said series circuit; and means for repetitively cycling said switch means to connect and disconnect said power supply from said series circuit, whereby the the flashtube is fired when the voltage across the capacitor reaches said threshold firing voltage.

7. An alarm circuit as set forth in claim 6 in which said means for repetitively cycling said switch means is operable to initiate the open part of the switch cycle in response to the attainment of a predetermined current through said inductor and to initiate the closed part of the switch cycle at regular intervals, whereby the same amount of energy is stored in the inductor during each cycle of the switch.

8. A strobe light circuit for flashing a flashtube at a desired frequency, comprising:

a dc power source for providing power at a predetermined voltage;

an inductor for storing energy;

switch means for connecting and disconnecting said inductor across said source to store energy in said inductor during the periods of connection;

a resistor connected in series circuit with said inductor across said source when said switch means is in its closed state;

a flash unit which includes said flashtube and is operable to fire said flashtube to generate a light output upon the application across said unit of its threshold firing voltage;

a capacitor connected in parallel to said flash unit so that said capacitor will cause the firing of said flashtube and the discharge of its stored energy through the flashtube upon the attainment of a voltage across said capacitor corresponding to said threshold firing voltage;

means for connecting said parallel combination of said flash unit and said capacitor across said inductor when said inductor is disconnected from said power source by said switch means; and means for repetitively cycling said switch means between its open and closed state, including an oscillator for providing an output pulse for each period of said switch cycling, and a flip-flop connected to receive said oscillator pulse output at its first input and operative in response to that pulse output appearing at said first input to produce an output from said flip-flop to said switch means of a level which will initiate the closed period of said switch, said flip-flop having a second input connected to receive a change in level when the current through said resistor reaches an initiating value, namely a value which will indicate storage in said inductor of sufficient energy in one switch cycle such that upon transfer of that energy to said capacitor during the open state of all of the switch cycles in the period of one flash cyvcle at the desired flash frequency to capacitor will attain a charge of sufficient energy to produce across said capacitor the threshold firing voltage of said flash unit, so that said flip-flop changes state and causes a change in state of its output such that said open state of said switch is initiated.

9. A circuit as set forth in claim 8 in which said power supply has across its terminals a dropping resistor and a zener diode operable to provide across the zener diode a regulated supply, said series circuit including the inductor and the resistor is connected across said power supply terminals, said oscillator and said flip-flop are connected across said regulated supply, and a feedback resistor connected between the side of the capacitor away from the power supply terminals and the junction between the dropping resistor and said zener diode so that the charge on said capacitor will assist in maintaining the level of said regulated supply.

10. A circuit as set forth in claim 9 which includes a first diode in series with the dropping resistor and zener diode poled so that current can not flow through said dropping resistor or zener diode when there is no alarm condition, and a second diode in series with the inductor and switch poled so that current can not flow in said inductor unless there is an alarm condition.

11. An alarm circuit of the type in which the power supply for the alarming unit has its polarity reversed to indicate an alarm condition, comprising:

a series circuit including at least an inductor for storing energy and a resistor for providing a voltage drop indicative of the current flow through said inductor;

a parallel circuit including a capacitor in parallel with a flash unit, said flash unit including a flashtube for providing a visual alarm and a triggering circuit for firing said flashtube when the voltage across said parallel circuit attains the threshold firing voltage of said triggering circuit;

switch means for connecting and disconnecting said power supply across said series circuit;

means for connecting said series circuit across said parallel circuit at least when said power supply is disconnected from said series circuit; and means for repetitively cycling said switch means to connect and disconnect said power supply from said series circuit, including a timing circuit operative to connect said switch means in response to timing pulses of a predetermined frequency and disconnect said switch means in response to the voltage drop across said resistor attaining a value indicative of a predetermined current flow through said inductor, said predetermined current flow and said predetermined frequency being jointly chosen to have values such that the energy stored in said inductor during the periods when said switch means is closed and transferred to said capacitor when said switch means is open is sufficient over the period of one flash cycle at a predetermined flashing frequency to bring the voltage across said capacitor to the threshold firing voltage of said flashtube.

12. In an alarm circuit of the type in which a power supply is connected in one polarity to a warning device to indicate an alarm condition and in the opposite polarity to indicate the absence of an alarm condition, the improvement comprising an inductor for storing energy for use in powering said warning device;

a switch means operable in one state to connect said supply to said inductor for charging said inductor and operable in another state to disconnect said supply from said inductor and connect said inductor to said warning device for discharge of said inductor through said warning device; and means for repetitively cycling said switch means so that the connection of said supply to said inductor is periodic in time and so that the disconnection of said supply from said inductor occurs upon the attainment of a predetermined charging current through said inductor from said supply.

* * * * *